US006314751B1

(12) United States Patent
Gjersvik

(10) Patent No.: US 6,314,751 B1
(45) Date of Patent: Nov. 13, 2001

(54) BEVERAGE CHILLING APPARATUS

(76) Inventor: Gilbert Sebastian Gjersvik, 157 E. 72nd St., Apt. 11A, New York, NY (US) 10021

( * ) Notice: Subject to any disclaimer, the term of this patent is extended or adjusted under 35 U.S.C. 154(b) by 0 days.

(21) Appl. No.: 09/715,734

(22) Filed: Nov. 17, 2000

(51) Int. Cl.[7] ..... F25D 3/08; F25D 25/02

(52) U.S. Cl. ..... 62/457.4; 62/381; 62/372

(58) Field of Search ..... 62/64, 379, 381, 62/457.4, 457.9, 371, 372

(56) References Cited

U.S. PATENT DOCUMENTS

| | | | | |
|---|---|---|---|---|
| 136,632 | * | 3/1873 | Whipple | 62/381 |
| 303,815 | * | 8/1884 | Cramer | 62/381 |
| 496,922 | * | 5/1893 | Wadhams . | |
| 2,216,762 | * | 10/1940 | Bolas | 62/381 |
| 3,316,734 | | 5/1967 | Crane . | |
| 4,078,397 | | 3/1978 | Brand . | |
| 4,164,851 | | 8/1979 | Bryant . | |
| 4,549,409 | * | 10/1985 | Smith | 62/381 |
| 4,580,405 | | 4/1986 | Cretzmeyer . | |
| 4,813,243 | * | 3/1989 | Woods et al. | 62/381 |
| 4,825,665 | | 5/1989 | Micallef . | |
| 5,005,378 | * | 4/1991 | Ottenheimer | 62/378 |
| 5,282,368 | * | 2/1994 | Ordoukhanian | 62/372 |
| 5,653,123 | * | 8/1997 | Handlin | 62/457.3 |
| 5,966,964 | * | 10/1999 | Pattee | 62/457.4 |

* cited by examiner

*Primary Examiner*—William C. Doerrler
(74) *Attorney, Agent, or Firm*—Frommer Lawrence & Haug LLP; William S. Frommer; Glenn F. Savit

(57) ABSTRACT

A chilling apparatus for chilling a liquid in a container includes a compartment sized to accept and retain the container; and a coolant receptacle adjoining a side portion of the compartment, for retaining a coolant, e.g., an ice/water mixture. The adjoining side portion has at least one aperture that allows the coolant to flow through to enter the compartment and surround the container therein. The liquid in the container is rapidly chilled via heat transfer between the container wall and the coolant when the container is rotated within the compartment. The rotation may be performed manually, e.g., via a holding member and handcrank attached to the top of the container, or automatically via an electric motor. The apparatus is particularly useful for chilling canned beverages. The apparatus can be configured to impart wobbling rotation to the container to achieve even faster chilling times.

30 Claims, 15 Drawing Sheets

BEVERAGE CHILLING APPARATUS

BACKGROUND OF THE INVENTION

1. Field of the Invention

The present invention relates to an apparatus for chilling liquids in containers, and more particularly, to rapidly chilling beverages in cans.

2. Description of the Related Art

An all too frequent occurrence for a beer or soda drinker is to realize, upon opening the refrigerator, that no cold beer or soda is in sight. The typical scenario in this circumstance is to place a warm beer from the closet into the freezer, and wait about 20–30 minutes for it to cool to a desired drinking temperature. Obviously, it would be highly desirable to provide a practical way to cool the beverage in a much shorter time, and without running the risk of the beverage freezing.

Previous designs for beverage chilling devices have not enjoyed substantial commercial success, as is evident by the dearth of such devices in stores today. One such prior art design is presented in U.S. Pat. No. 4,580,405 to F. Cretzmeyer, III, which discloses a beverage cooling device having an ice receptacle with an open upper end. An electric motor is mounted in a track on the exterior of one of the receptacle walls, and is free to move upwardly and downwardly within the track. Ice is placed at the bottom of the receptacle and a beverage can is placed on top of the ice. A suction cup attaches the can to the motor through a shaft opening in the side wall of the receptacle. The motor then rotates the can to frictionally engage the can with the ice. U.S. Pat. No. 4,078,397 to B. Brande discloses a similar beverage container cooling device employing the same principle of rotating a can over a bed of ice. The device employs a side hand crank that rotates the can in frictional contact with the ice. A drawback to this technique, as well to the method in the '405 patent, is that any given time the ice only contacts a limited portion of the container, thereby limiting the speed at which the canned beverage can be cooled. In addition, the frictional contact with the ice limits the speed at which the rotation can occur.

U.S. Pat. No. 4,825,665 to C. Micallef is directed to a wine cooling apparatus including a bottle holder which holds a bottle within an ice and water mixture in a container that is rotatably mounted on a turntable. When the turntable is rotated, the container rotates and fins on the inside of the container stir the mixture and cause it to swirl around the surface of the bottle, thereby cooling the wine. This apparatus, however, appears to be complex and not easily adaptable to canned beverages.

SUMMARY OF THE INVENTION

In an illustrative embodiment of the present invention, a chilling apparatus for chilling a liquid in a container includes a compartment sized to accept and retain the container; and a coolant receptacle adjoining a side portion of the compartment, for retaining a coolant such as an ice/water mixture. The adjoining side portion has at least one aperture that allows the coolant to flow through to enter the compartment and surround the container therein. The liquid in the container is rapidly chilled via heat transfer between the container walls and the coolant when the container is rotated within the compartment. The rotation may be performed manually, e.g., via a hand crank and holding member attached to the top of the container, or automatically via an electric motor.

The apparatus is particularly useful to provide a practical way to chill canned beverages. Via typical manual or automatic rotation of the can, for example, cooling of the beverage from room temperature to an ice-cold temperature can be accomplished in less than two minutes. The apparatus may include a means for imparting wobbling rotation to the container to enable the liquid therein to be chilled even faster.

BRIEF DESCRIPTION OF THE DRAWINGS

The following detailed description, given by way of example and not intended to limit the present invention solely thereto, will best be appreciated in conjunction with the accompanying drawings, in which like reference numerals denote like elements and parts, wherein.

DETAILED DESCRIPTION OF PREFERRED EMBODIMENTS

Figure 1:
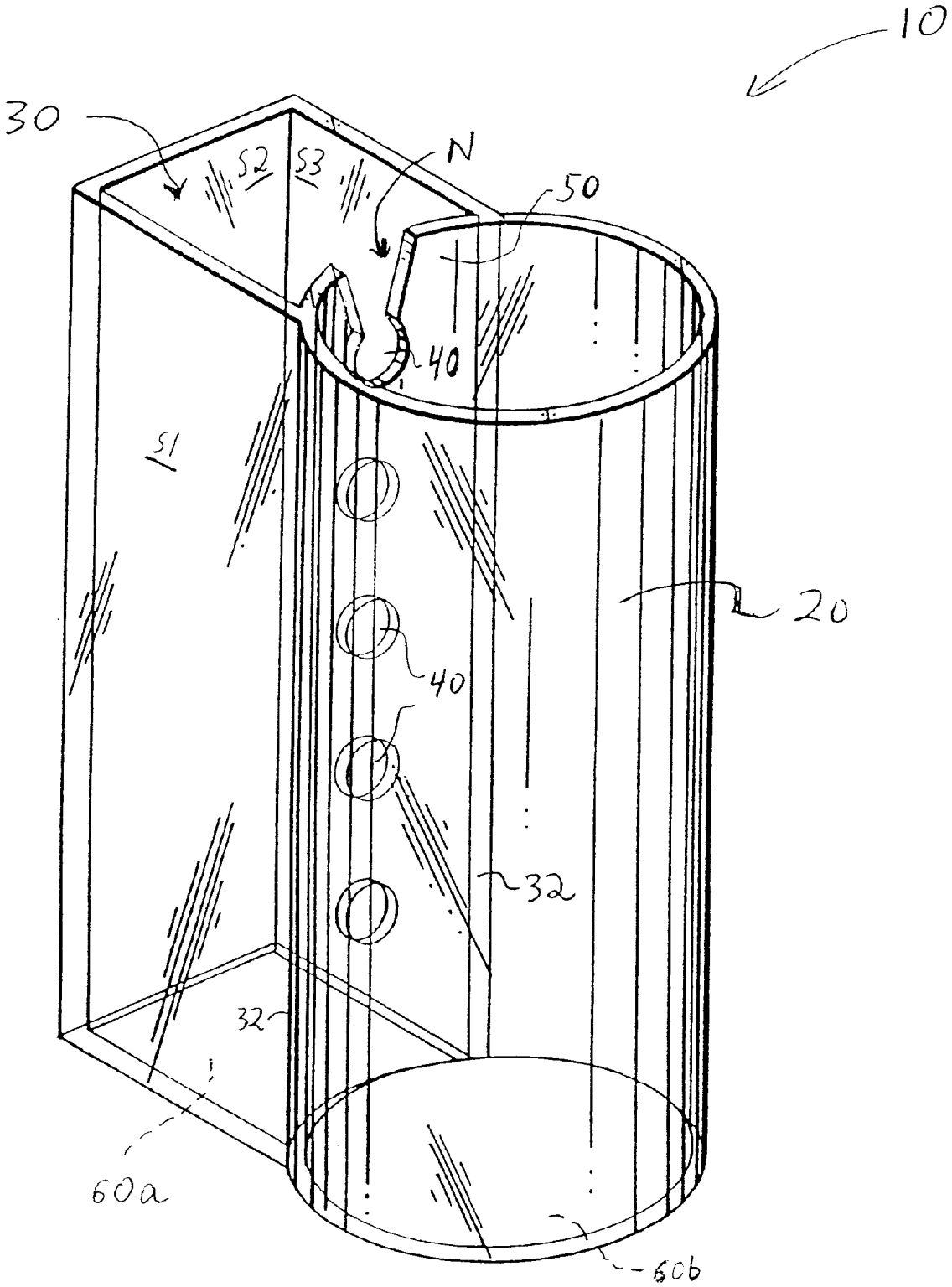
FIG. 1 is a perspective view of an embodiment of a liquid chilling apparatus in accordance with the invention.

Referring to FIG. 1, an illustrative embodiment of a liquid chilling apparatus, 10, in accordance with the invention is shown in a perspective view. Chilling apparatus 10 is composed of a cylindrical compartment 20 for accepting and retaining a container (e.g., can) containing the liquid to be chilled; and a coolant receptacle 30 adjoining a side portion 50 of compartment 20. A plurality of apertures 40 are formed in the side portion 50, each of which are preferably smaller than a standard size ice cube.

Typically, as will be described in further detail hereafter, the user fills coolant receptacle 30 with ice cubes, and places a canned beverage to be chilled in compartment 20. The user then pours water into receptacle 30 until it is nearly filled. The water seeps through apertures 40, thereby surrounding the can. In the simplest arrangement, the can is then rotated manually for about one to two minutes, thus chilling the beverage via heat transfer between the can wall and the cold water surrounding it. The manual rotation can be accomplished, e.g., with the user's finger; a simple tool such as a pencil or the like; or an L-shaped member as a hand-crank (described below) attachable to the container. (Hereafter, the terms "container" and "can" will be used interchangeably, but it is understood that containers other than cans can likewise be chilled with the apparatuses described herein.) Embodiments to implement automatic rotation of the can via an electric motor are also contemplated, as will be described later. Note that the invention is more useful for chilling beverages in cans rather than bottles, in that chilling of canned beverages can be accomplished in roughly half the time as bottled beverages due to the relatively poor heat transfer properties of thick glass.

With continuing reference to FIG. 1, chilling apparatus 10 is preferably composed of transparent plastic, which is ideal for its insulating properties as well as its low cost for high volume manufacturing. In addition, the transparency of the plastic allows the user to easily see the water level. Other materials may alternatively be utilized. In the illustrative embodiment, receptacle 30 is comprised of three sides S1, S2 and S3; a base 60*a*; and side portion 50 which is shared with compartment 20. Sides S1 and S3 are joined to the cylindrical compartment 20 at edges 32. Receptacle 30 is thus formed with a generally square or rectangular cross section. Note that other shapes for the receptacle can be used in the alternative to form different ornamental designs. Moreover, instead of circular apertures 40, a single long slit or a plurality of apertures of other shapes may be formed. Compartment 20 has a base 60*b* which may be unitary with the receptacle base 60*a*. In practice, compartment 20 and receptacle 30 are typically formed in a mold as one unitary piece.

The annexing of coolant receptacle 30 to the side of cylindrical compartment 20 affords a number of advantages over other techniques. First, the configuration is compact as compared to, for example, a design employing an outer cylinder concentric with cylindrical compartment 20 (in which the space between the two cylinders is used as the coolant receptacle). Second, the annexed receptacle 30 is easily filled with ice. For instance, the user may press receptacle 30 against a refrigerator's ice dispenser to dispense ice directly into receptacle 30, in the same manner as one would fill a cup of ice. (A double cylinder design would not be conducive to this method, as the space in between the cylinders would be too small, or, the apparatus would be too large to fit into a standard refrigerator ice dispenser channel.)

Figure 2:
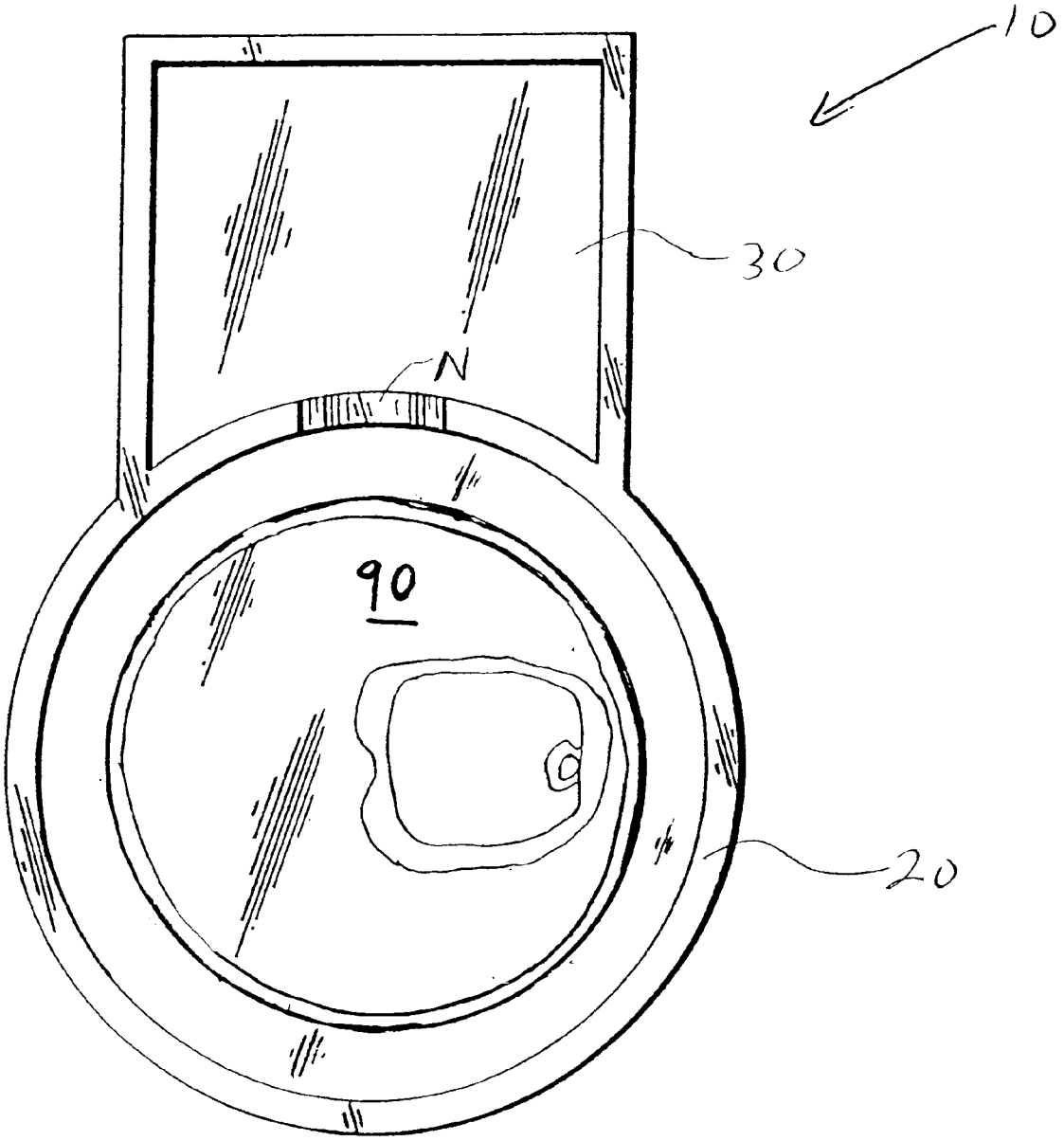
FIG. 2 is a top view of the apparatus of FIG. 1.

A notch N is formed on the top part of side portion 50. The notch facilitates removal of the chilled container within compartment 20. That is, the height of compartment 20 is preferably designed slightly higher than a standard beverage can size, e.g., taller than a 12 oz. can, thus ensuring the can is completely surrounded with cold water during the chilling procedure. Consequently, after a manual chilling operation, the can may rest on the bottom of compartment 20. Notch N facilitates removal of the can as the user inserts a finger through notch N and presses against the side of the can while lifting the can up for removal. In this manner, apparatus 10 need not be turned upside down to remove the can. The top view of FIG. 2 illustrates that the circumference size designed for compartment 20 may be only slightly larger than that of a standard can 90 inserted therein to be chilled; hence, the utility of notch N is appreciated. (Alternative container elevation systems will be described later with reference to FIGS. 7 and 8.)

Figure 3:
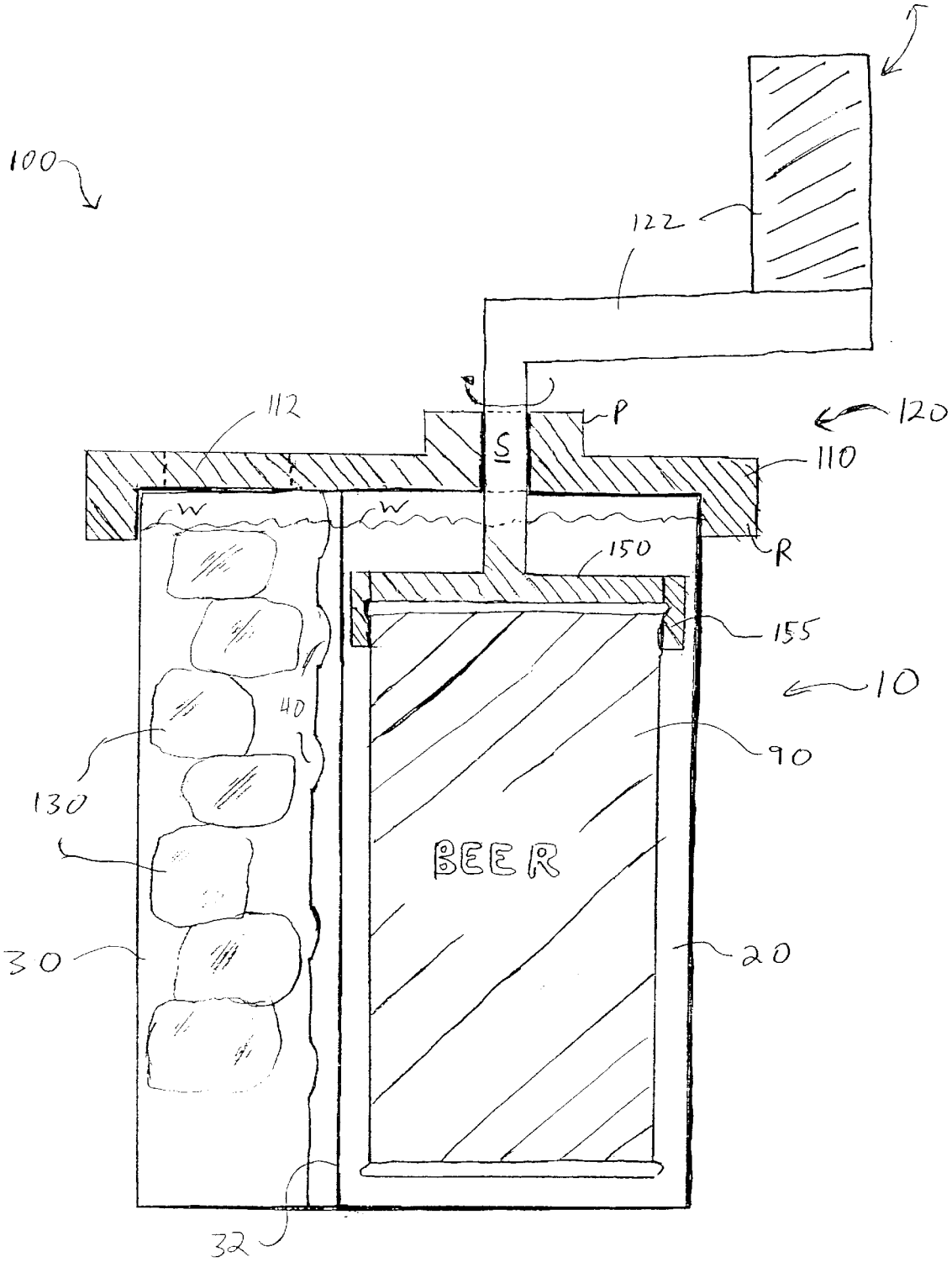
FIG. 3 is a side sectional view of the illustrative apparatus configured with a manual rotation mechanism.

With reference now to FIG. 3, an embodiment 100 of a manually operated liquid chilling apparatus in accordance with the invention is depicted in a cross sectional view. Apparatus 100 is comprised of the above-described apparatus 10 with the addition of a cover/hand-crank assembly 120. Assembly 120 is comprised of a hand-crank 122, a holding member 150 for holding a container 90 during the chilling procedure, and a cover 110 having a rim R that fits snugly over the perimeter of apparatus 10. Cover 110, hand crank 120 and holding member 150 may be integrated as a single unit that is placed on and removed from apparatus 10. A shaft S extends from hand crank 122 through an aperture of cover 110 and attaches to, or is unitary with, holding member 150. Optionally, shaft S may fit into a socket (not shown) of hand crank 122 to permit detachment therefrom.

To chill a liquid within a container (e.g., can) 90, the container is placed onto holding member 150 and then the cover/hand-crank unit 120 is placed over apparatus 10, lowering container 90 into compartment 20. Ice 130 and water W may be placed within receptacle 30 prior to the container being lowered into compartment 20. Optionally, cover 110 has an opening 112 to enable ice to be dropped and water to be poured therethrough and into receptacle 30 after the suspended container 90 is lowered into compartment 20. With the latter method, the user need not be concerned about overflow of water following immersion of container 90 in the water. Instead, while container 90 is already fully inserted, water can be poured through opening 112 over the ice to a desired level, preferably to the top of container 90. In any event, to prevent subsequent overflow for cases where coolant (e.g., ice/water) is poured in prior to the can immersion, a measuring line (not shown) is preferably inscribed on apparatus 10 approximately half way up.

With container 90 immersed in cold water W within compartment 30 and held suspended by holding member 150, the user rapidly turns hand crank 122 to thereby rotate shaft S. Container 90 is thereby rotated, and the water is circulated between compartment 20 and receptacle 30 through apertures 40. With typical manual rotation in this manner, e.g., about 60 revolutions per minute, the heat transfer between the container 90 wall and the cold water results in a beverage such as beer or soda within container 90 being chilled from room temperature to a temperature of about 40° F. in about 1½ minutes. Note that in cases where a carbonated beverage within container 90 is chilled, the spinning of container 90 does not result in excessive build up of gas therein as may otherwise occur if the container were shaken. Consequently, container 90 can be opened immediately after the chilling operation.

Figure 4:
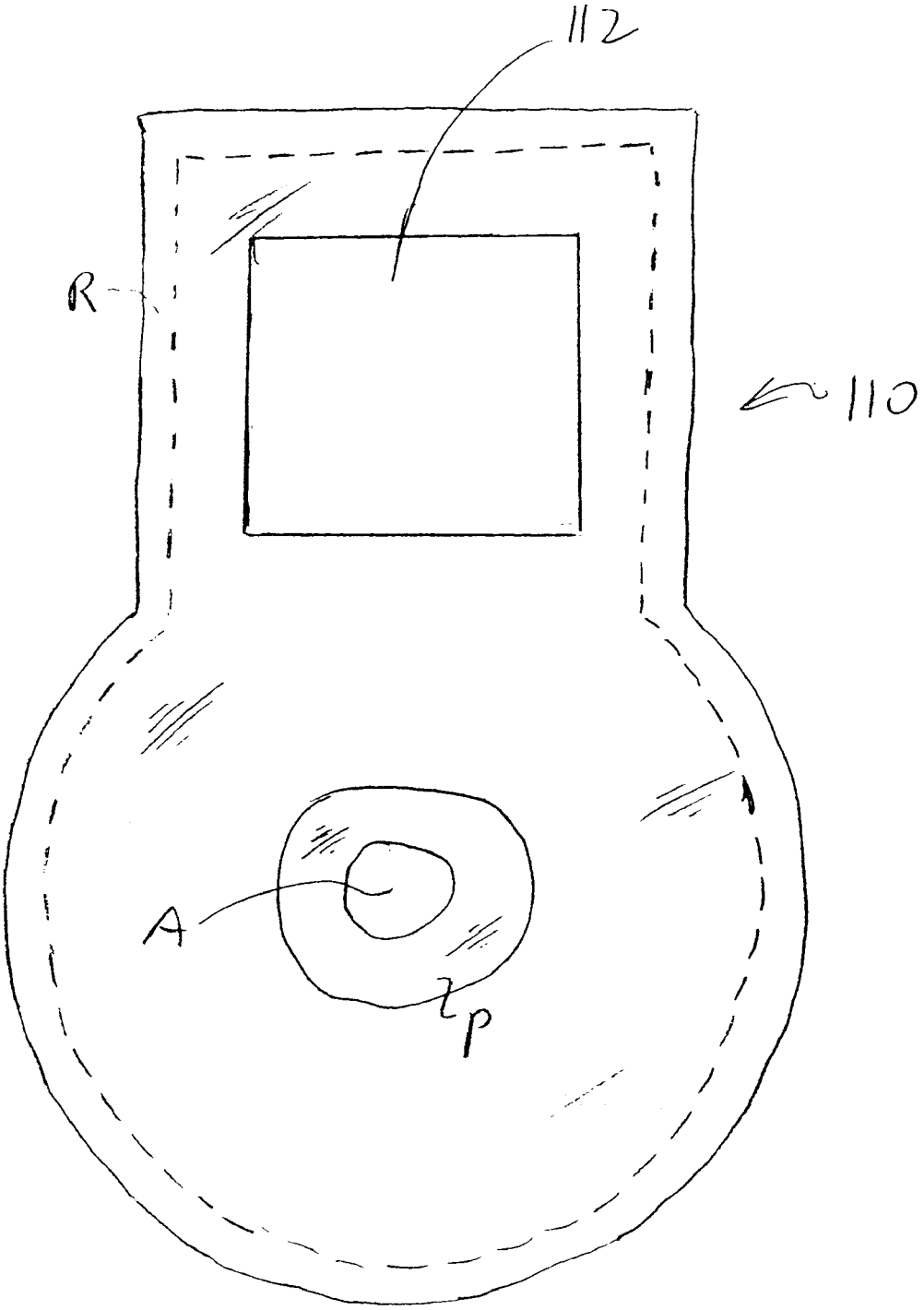
FIG. 4 is a top view of a cover for the apparatus.

FIG. 4 is a top view of an exemplary cover 110 shown removed from assembly 120, illustrating the above-noted opening 112; rim R (on the opposite side of the view) which fits snugly around the perimeter of apparatus 10; aperture A through which shaft S passes; and a post P serving as a support for hand crank 122.

Figure 5A:
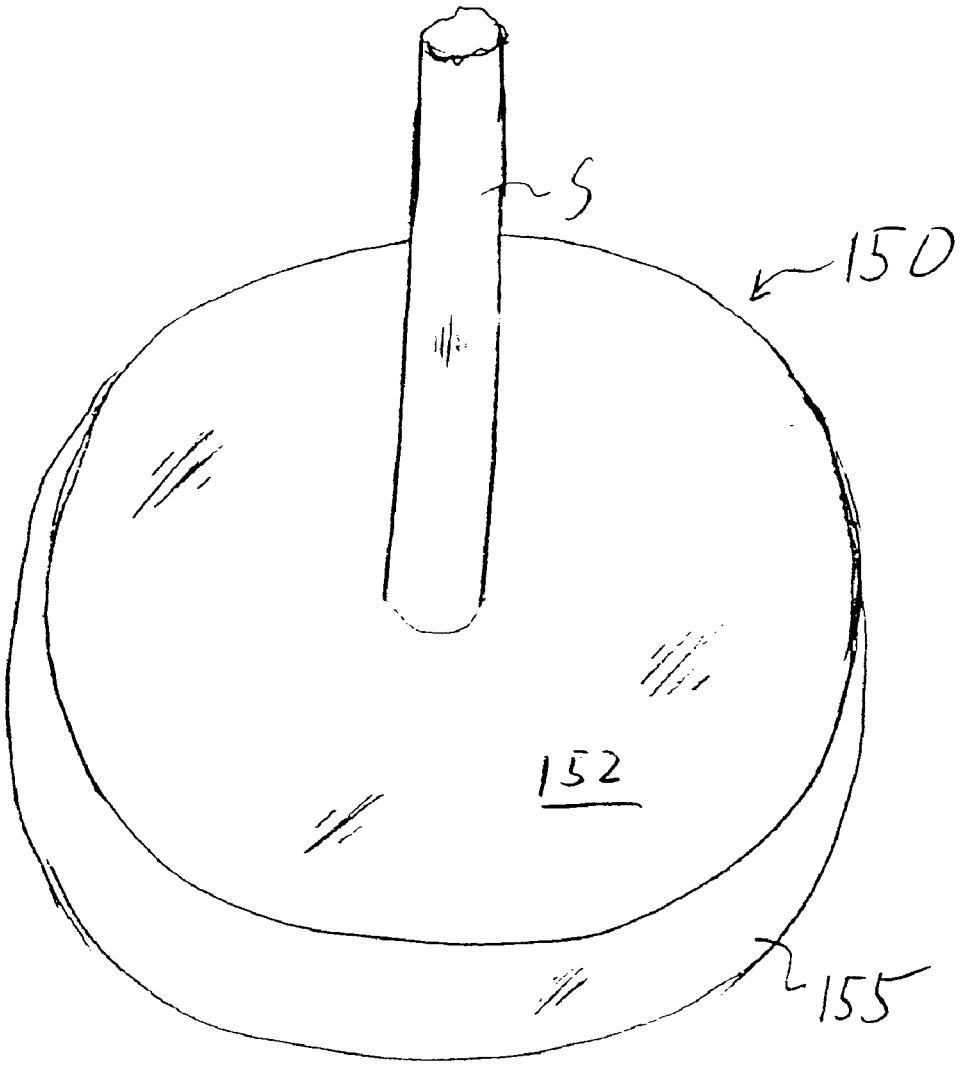
FIGS. 5A, 5B and 5C are perspective, bottom and side views, respectively, of an exemplary can holding member.
Figure 5B:
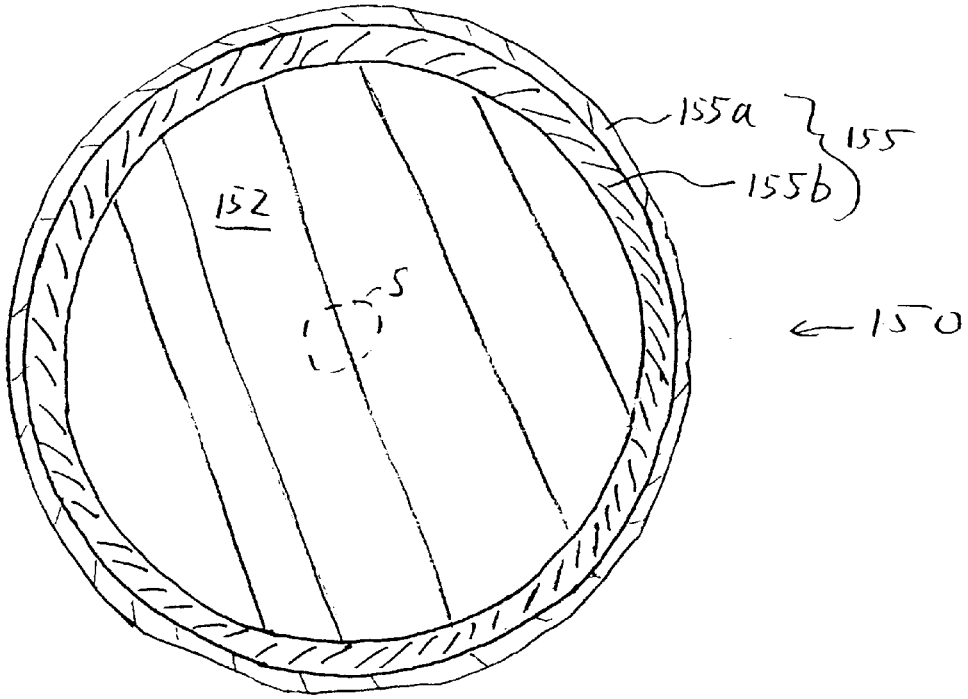
Figure 5C:
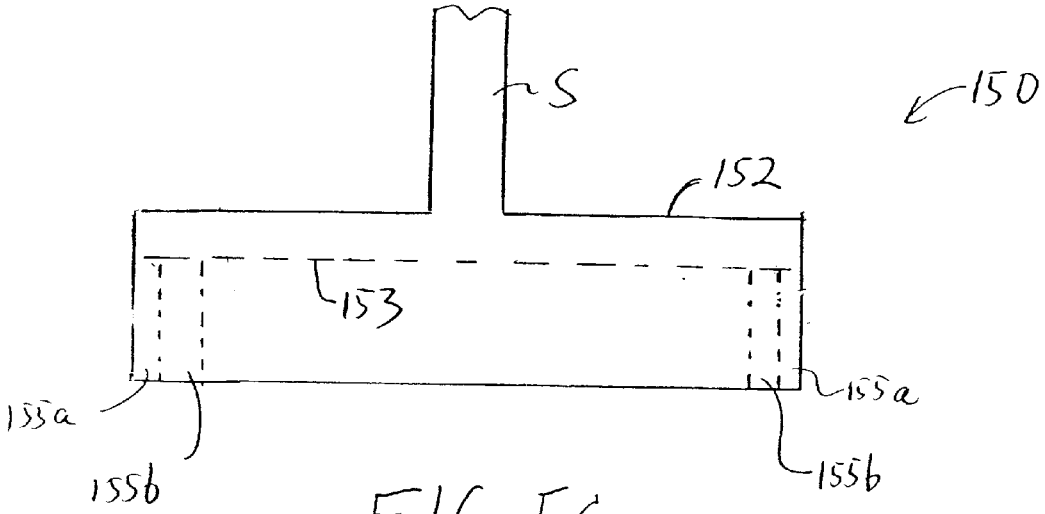

FIGS. 5A, 5B and 5C are perspective, bottom and side views, respectively, of an embodiment of holding member 150. As shown in FIG. SA, holding member 150 is shaped as a lid that comprises a sleeve portion 155 for retaining a cylindrical can, and a top portion 152 to which shaft S is affixed. Shaft S may be either unitary with portion 152, or removably attached to portion 152 in a suitable manner. As seen in the bottom view of FIG. 5B, sleeve portion 155 is comprised of a plastic outer sleeve 155*a* and a flexible rubber inner sleeve 155*b* which can be glued to outer sleeve 155*b*. Rubber sleeve 155*b* has an inner circumference dimensioned slightly smaller than a standard size beverage can, so as to compress against the can when the can is inserted into the sleeve. The compression of the rubber sleeve 155*a* provides a compressive force sufficient to hold the can 90 suspended within water when the shaft S and can are rapidly rotated. When fully inserted, the top surface of the can butts against bottom surface 153 of the holder top portion 152, and remains substantially at that position during can rotation.

In any event, it is understood that alternative holding members can be employed to hold container 90 during rotational chilling operation. For instance, the sleeve-type holding member 150 can be replaced by a suction cup or a spring finger-clasp type retaining mechanism in alternative embodiments.

Figure 6:
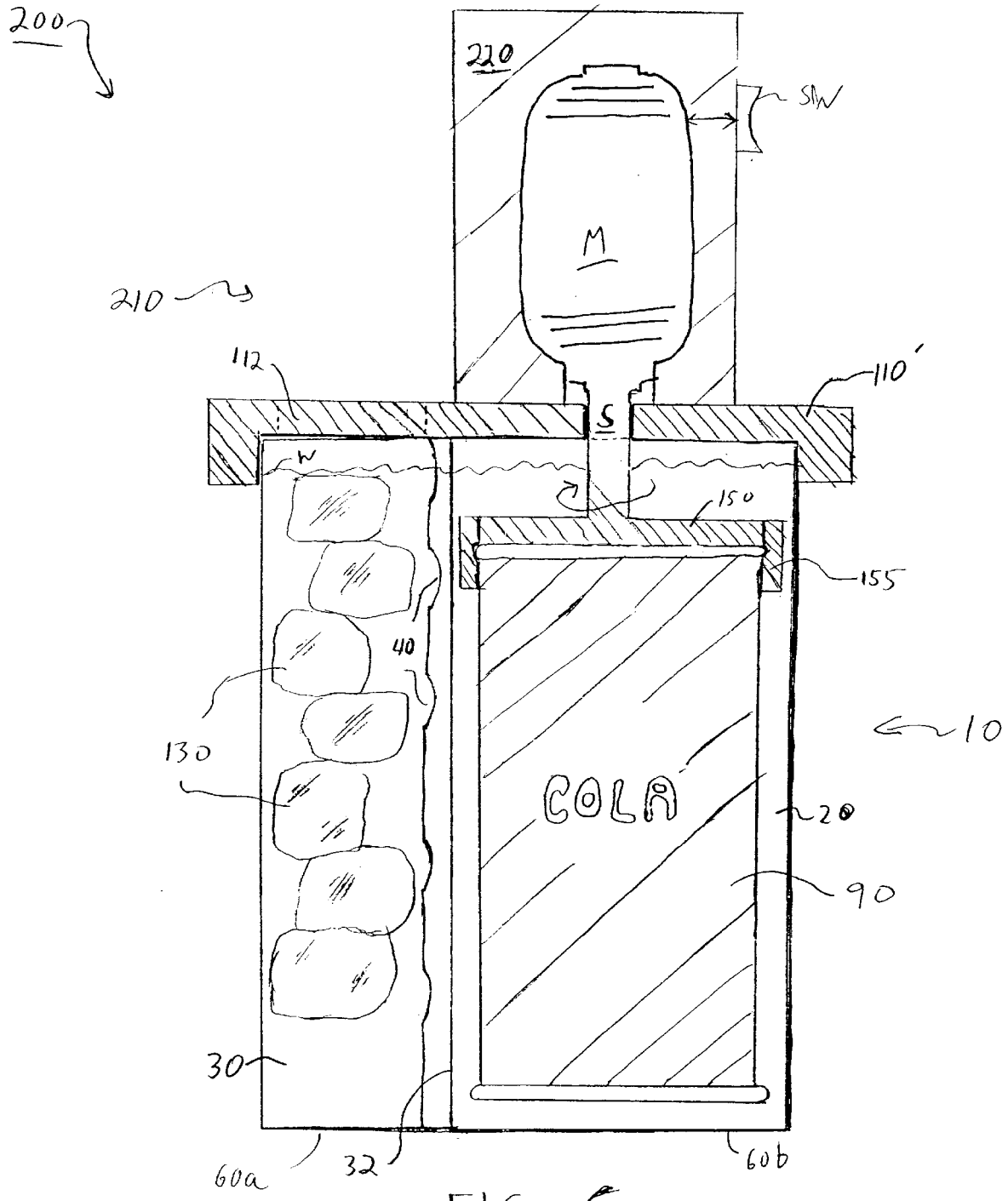
FIG. 6 is a side sectional view of an embodiment of a liquid chilling apparatus configured with an electric rotation mechanism.

Turning now to FIG. 6, there is shown another embodiment, 200, of a liquid chilling apparatus in accordance with the invention. Chilling apparatus 200 includes the above-described apparatus 10 in conjunction with an electric rotation assembly 210. Rotation assembly 210 includes a water-proof housing 220 containing an electric motor M that rotates a shaft S when a switch SW is activated. Motor M can be powered either by batteries (not shown) within housing 220, or via an external line voltage by means of a cord extending from housing 220. Housing 220 is affixed atop cover 110', which is similar or identical to the above-described cover 110. (In practice, housing 220 can be provided as an extension of cover 110'.) Shaft S is attached to (or unitary with) holding member 150 for holding container 90 during the chilling operation in the same manner as described previously.

In operation, with electric rotation assembly 210 apart from apparatus 10, the container 90 is placed onto holding member 150. Next, assembly 210 with container 90 suspended is fitted onto apparatus 10, thereby lowering container 90 within compartment 20. Water is then poured through aperture 112 onto ice 130 in receptacle 30 (unless it was done so previously). Switch SW is then activated to rotate shaft S and container 90. A rotation speed of on the order of 60 revolutions per minute has proven sufficient to cool a room temperature canned beverage to an ice-cold temperature in less than two minutes. After chilling, assembly 210 is lifted from apparatus 10 to remove the chilled container 90. Note that in the alternative, bases 60*a* and 60*b* may be designed to be removable from apparatus 10 to permit container 90 to be removed from holding member 150 by pulling (and also to be inserted on holding member 150 prior to the chilling procedure). In the latter case, assembly 210 and apparatus 10 can be permanently or semi-peimanently attached.

As a variation to the top-mounted electric motor assembly depicted in FIG. 6, a side mounted motor assembly can be annexed a side portion of apparatus 10. The side mounted motor assembly could employ a gear mechanism to rotate shaft S and holding member 150.

Figure 7:
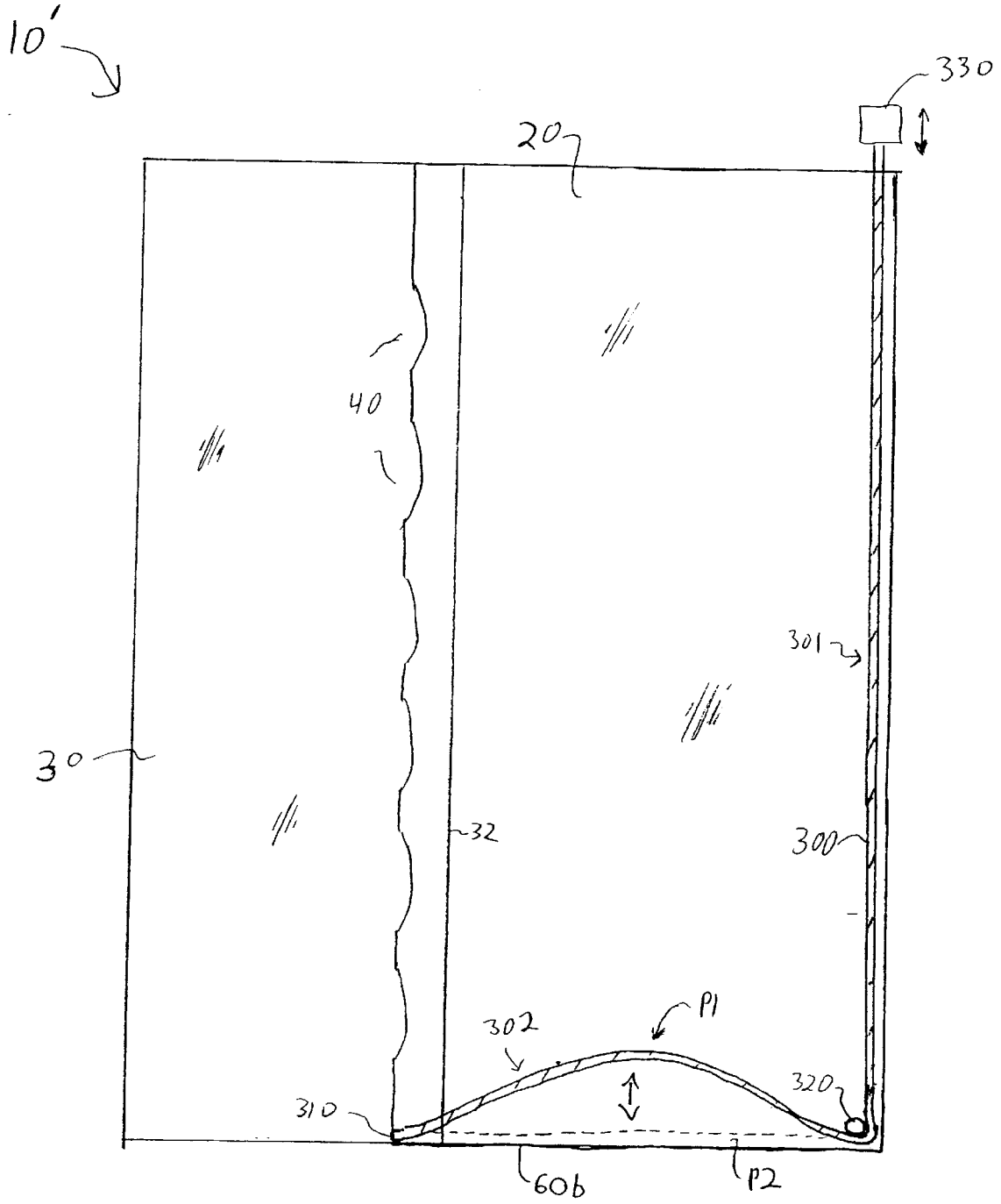
FIGS. 7 and 8 are side views of embodiments of liquid chilling apparatuses having respective container elevation systems.

Referring to FIG. 7, another embodiment 10' of a liquid chilling apparatus in accordance with the present invention is shown in a side view. This embodiment is basically the same as apparatus 10 described above, with the addition of a container elevation system to facilitate removal of the chilled container. The container elevation system is comprised of a long thin flexible member 300 having a side portion 301 that extends vertically along the outer side of the cylindrical wall of compartment 20, and a bottom portion 302 disposed at the base 60*b* of compartment 20. Flexible member 300 extends beneath a post 320 that is suitably affixed to compartment 20. The edge portion of member 300 is attached at region 310 to the opposite side of compartment 20. A tab 330 is provided at the top of member 300. When the tab is pushed down, as shown in FIG. 7, bottom portion 302 buckles up to position P1 to lift a chilled container (not shown) resting thereon such that the container protrudes above the top of compartment 20, allowing the user to easily grasp it. When a container is pushed inside compartment 20 prior to the chilling operation, or when tab 330 is pulled up, bottom portion 302 is pushed down to position P2. Note that with the use of a container elevation system as in FIG. 7, the notch N (FIG. 1) can be eliminated if desired.

Figure 8:
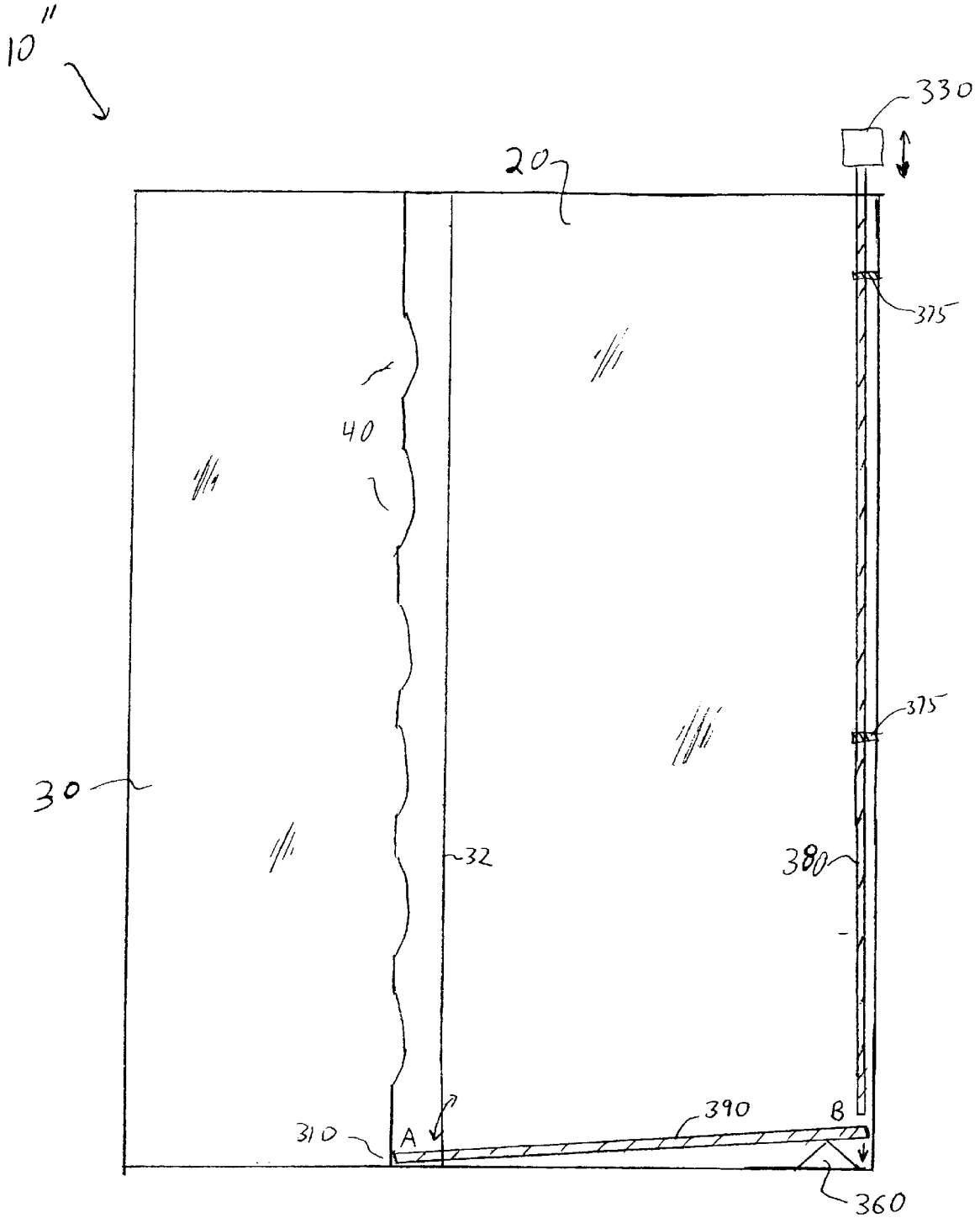

FIG. 8 shows another embodiment of liquid chilling apparatus, 10", which has a different container elevation system. A push rod 380 is provided at the outer edge of compartment 20, and held loosely in place via fasteners 375 or the like. Another member 390 rests at the bottom of the compartment, with one end B sitting atop a fulcrum 360, and an opposite end at the other side of compartment 20. When rod 380 is pushed down via tab 330 onto end B, the opposite end A of member 390 lifts up to thereby raise a chilled container (not shown) resting on member 390. The container is raised sufficiently high to protrude slightly from the top of apparatus 10, allowing the user to easily grasp and remove it.

Figure 9:
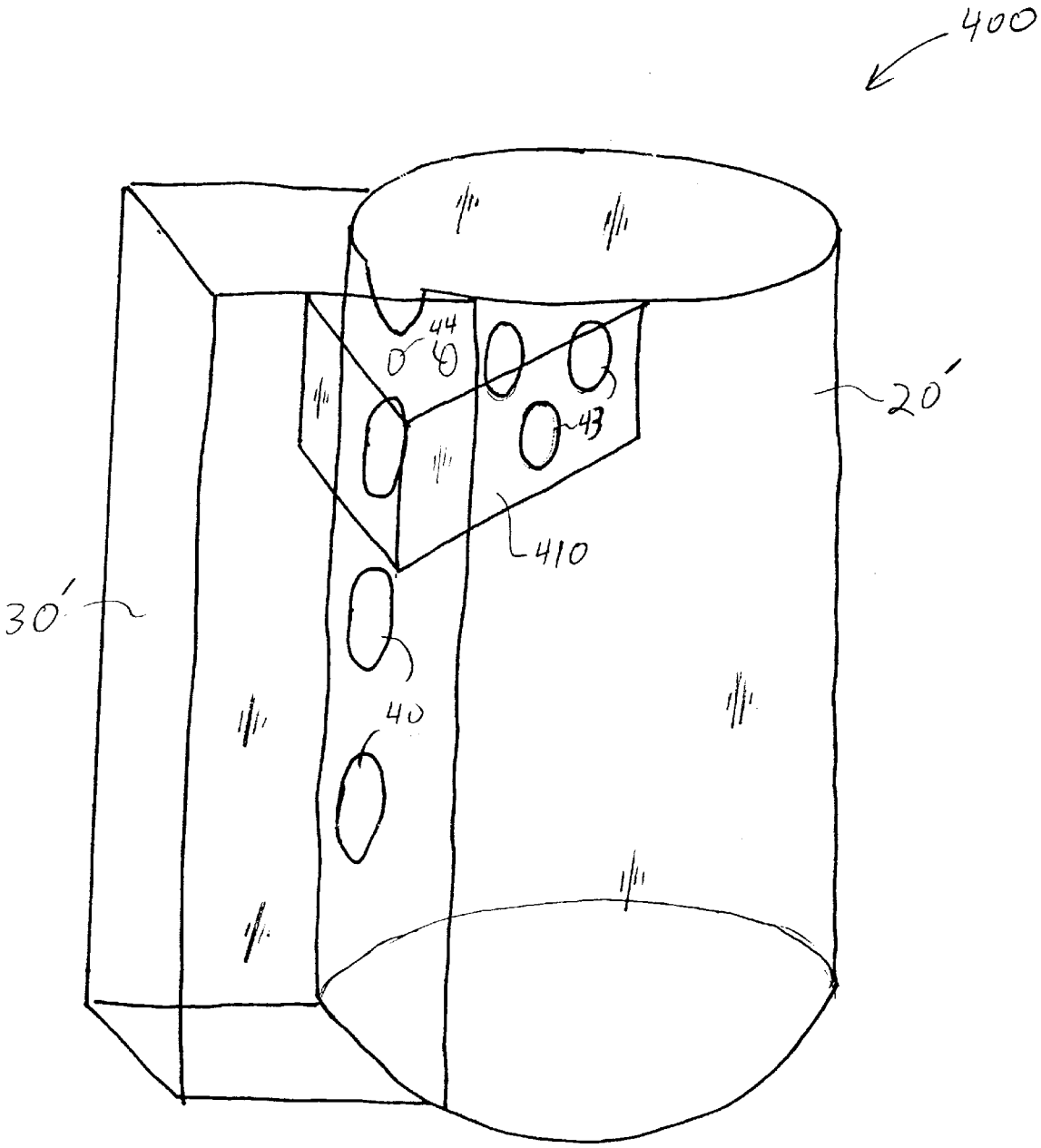
FIGS. 9 and 10 are perspective and top views, respectively, of an embodiment of a liquid chilling apparatus that includes a salt dispenser.
Figure 10:
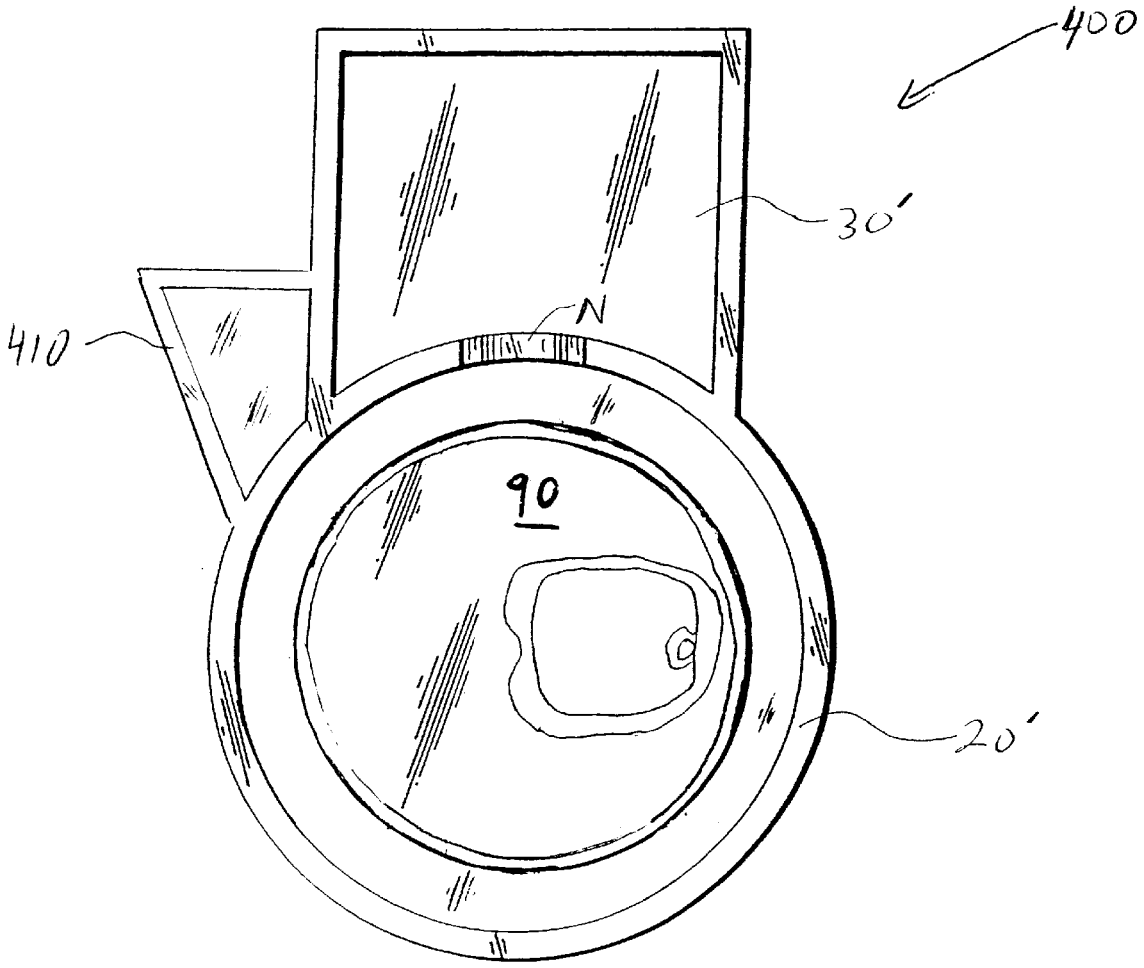

FIG. 9 depicts yet another embodiment of a liquid chilling apparatus, 400, in a perspective view. Apparatus 400 includes a coolant receptacle 30', compartment 20' and a salt dispenser 410 adjoining the top portions of compartment 20' and receptacle 30'. The latter are the same as compartment 20 and receptacle 30 described above, except that apertures 44 are formed in coolant receptacle 30' and apertures 43 are formed in compartment 20'. These apertures allow coolant to flow through and dissolve salt (or an equivalent substance) that has been placed within dispenser 410. The dissolved salt serves to maintain the coolant temperature cold for a longer period of time than it would be otherwise. This approach reduces the frequency at which coolant would need to be replaced when the liquid chilling apparatus is repeatedly used over a relatively long period of time to chill many beverages or other liquids. Salt dispenser 410 can be annexed to any one of the other embodiments presented hereinabove as well. A top view of apparatus 400 is illustrated in FIG. 10, with a beverage can 90 immersed therein.

Figure 11A:
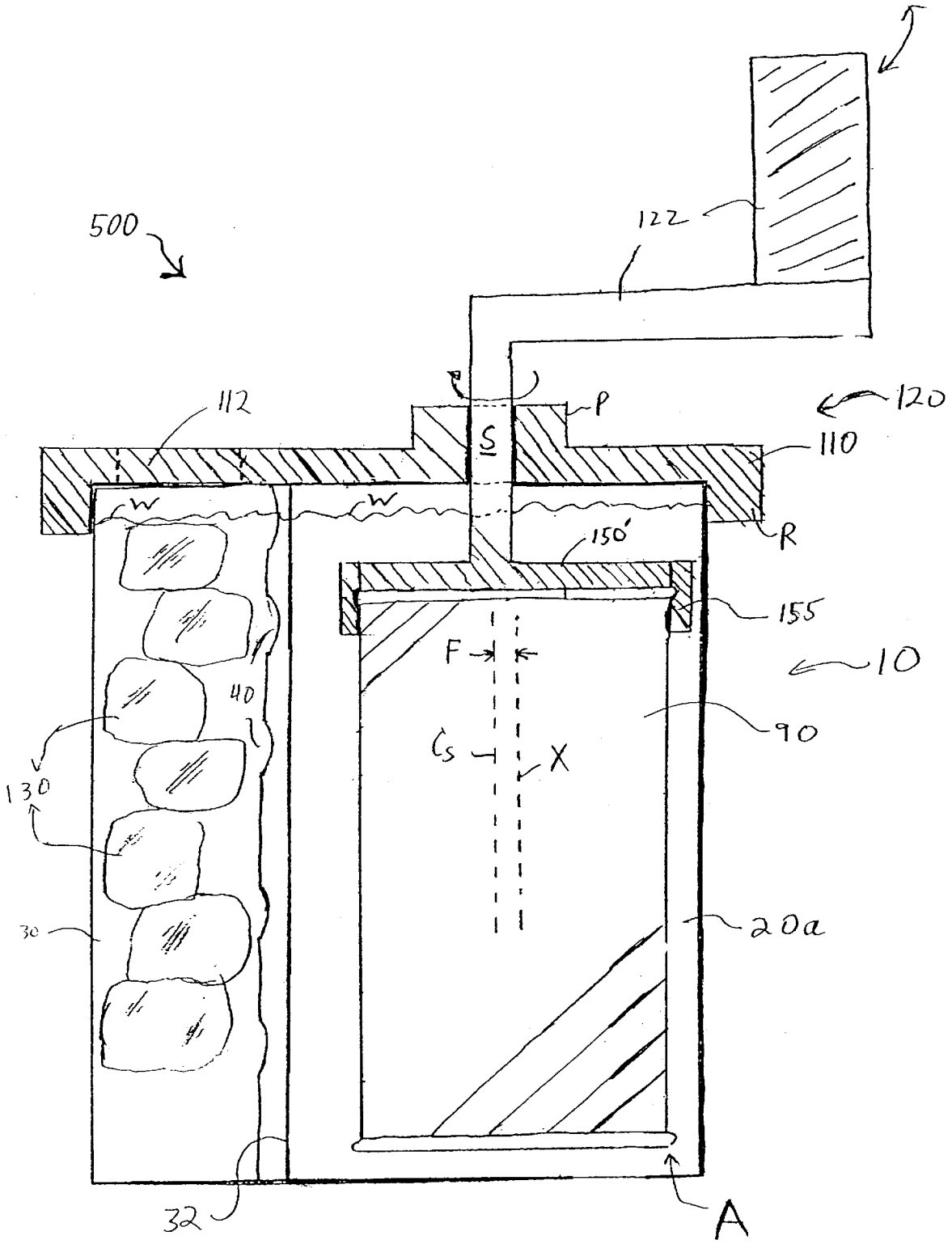
FIGS. 11A and 11B are respective sectional views of another embodiment of the invention.
Figure 11B:
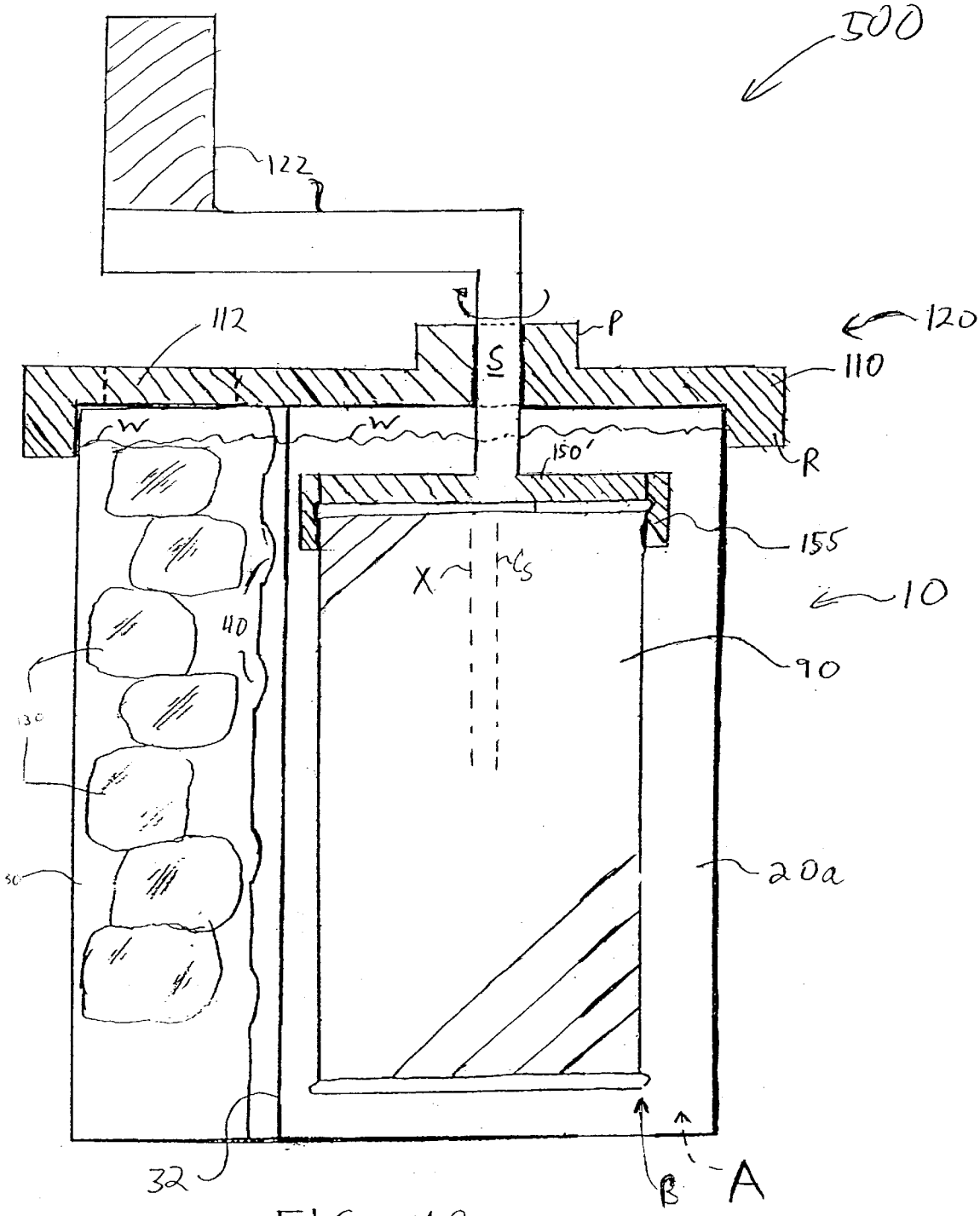

Referring now to FIG. 11A, still another embodiment of a liquid chilling apparatus, 500, is illustrated in a cross sectional view. This embodiment is designed to chill liquids slightly faster than in the above-described cases by achieving a wobbling effect during can rotation. In particular, apparatus 500 differs from the above-described apparatus 100 of FIG. 3 in that rotational shaft S attaches to (or is integrated with) a holding member 150' at a position that is offset by a distance F with respect to the axis X of can 90 held by member 150'. Thus, as shaft S is rotated about its axis in the same manner as in the previously described embodiments, the can 90 spins and also continually changes its lateral position with respect to the vertical edges of compartment 20*a*, i.e., it wobbles within the coolant compartment 20*a*. Experiments have shown that this wobble effect results in liquids within container 90 being chilled approximately 10–25% faster as compared to the case of spinning the can in a stationary position about its axis (as in FIG. 3). Note that embodiment 500, while illustrated in the manually-operated case in FIGS. 11A and 11B, is equally applicable to a motorized embodiment as in FIG. 6 by simply replacing hand crank 122 of FIGS. 11 with motor assembly 220 of FIG. 6. The reduction in chilling time is realized for the motorized embodiment as well.

To illustrate the wobbling motion, in FIG. 11A the right side edge of can 90 is at position A, with the handle of hand crank 122 at the right-most position. In this position, the shaft center line $C_s$ is to the left of the can axis X. Also, there is less clearance between the can and the compartment 20*a* wall on the right side than on the left side. As shown in FIG. 11B, when handle 122 is rotated 180° such that it is moved to the left-most position in this example, the tight side edge of can 90 winds up at position B, such that the can to compartment wall clearance is greatest on the right hand side. Thus, as hand crank 122 is spun in an ordinary manner, can 90 is wobbled within chilling compartment 20*a*, whereby the liquid within can 90 circulates against the can walls more vigorously, thereby reducing the chilling time. It is noted that if necessary, the diameter of compartment 20*a* is slightly larger than compartment 20 to provide adequate clearance between the can and the compartment 20*a* sidewalls during the wobbling motion.

In this example, holding member 150' can be essentially of the same design as holding member 150 described previously, except that shaft S is offset from the center of the holding member 150' rather than being centrally aligned as with holding member 150. It is understood that alternative holding members can be used to replace the illustrated member 150', such as a suction cup with an offset or non-linear shaft, and so forth.

Figure 12:
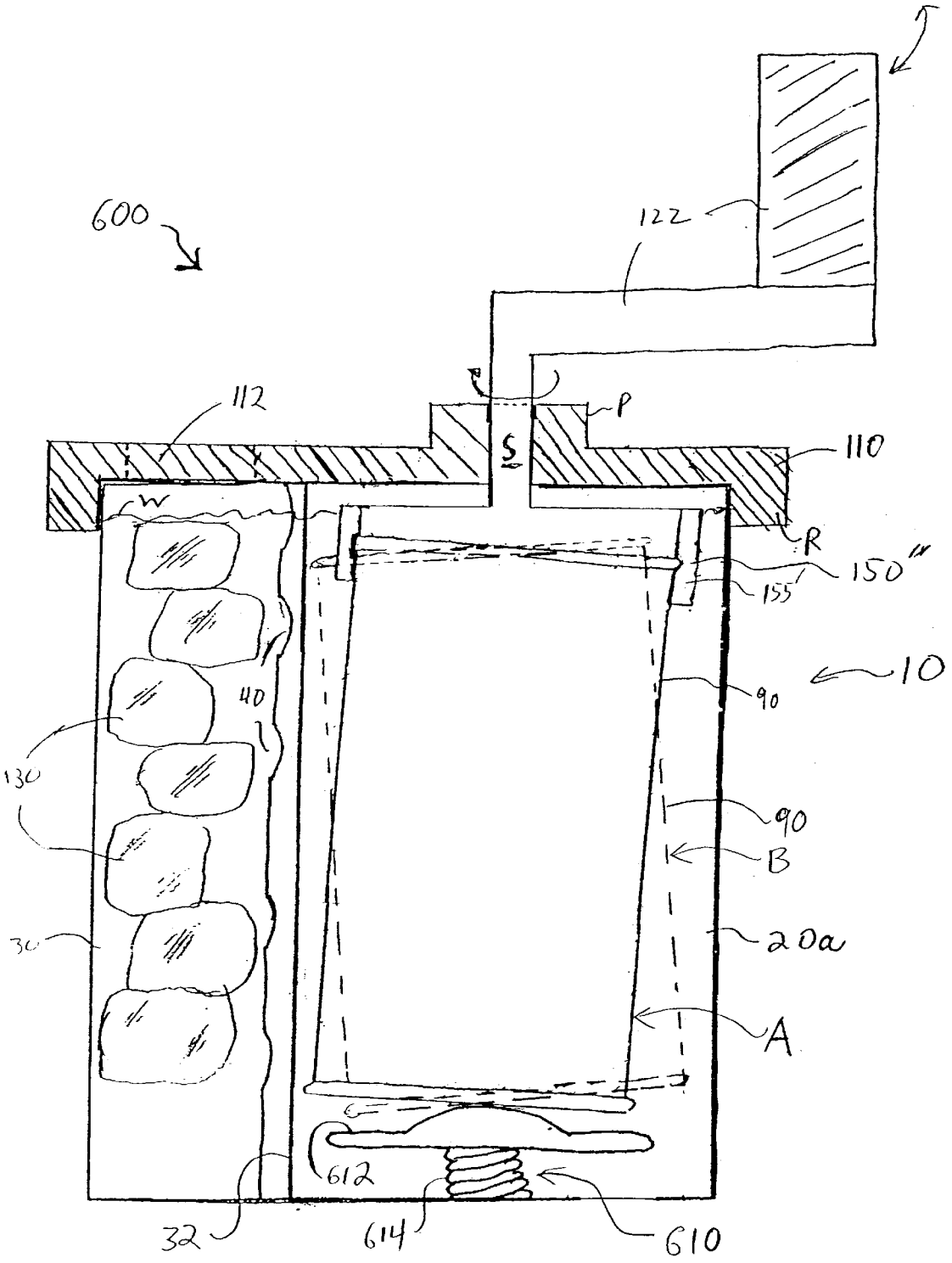
FIG. 12 is a sectional view of yet another embodiment of the invention.

Turning now to FIG. 12, still another alternative embodiment, 600, of a liquid chilling apparatus in accordance with the invention is illustrated, which is a variation of the "wobbling can" embodiment 500 just described. With apparatus 600, the can 90 to be chilled is retained, during its rotation, in a tilted orientation with respect to the rotating shaft S. As a result, when shaft S rotates about its axis (in the same manner as in the above-described embodiments), can 90 wobbles in three dimensional space, and the wobbling action reduces chilling time relative to the case of the can normally spinning about its axis. The wobbling motion is illustrated in FIG. 12 as follows: when hand-crank 122 is at the right-most position as shown, can 90 is oriented at position A; when hand-crank 122 is rotated 180°, can 90 is rotated to the orientation B illustrated by the dotted line outline in the figure. To maintain can 90 in a skewed orientation relative to rotating shaft S, the can is held by holding member 150", which is a modified version of the above-described member 150.

To help support can 90 during such wobbling motion, an optional flexible member 610 is attached to the bottom of chilling compartment 20*a*, upon which can 90 rests. As can 90 tilts in various directions during the wobbling rotation, flexible member 610 flexes in tandem. Flexible member 610 can be embodied with a flexible screw portion 614 affixed to the compartment 20*a* base, and a top surface portion 612 upon which can 90 rests.

Instead of shaft S being rotated by the manual hand-crank as depicted in FIG. 12, shaft S can be attached to a motor to achieve electric rotation thereof, in the same manner as illustrated in FIG. 6. Note also that shaft S is shown in FIG. 12 centrally positioned with respect to holding member 150". Alternatively, shaft S can be laterally offset with respect to the center of holding member 150" and thus with respect to the can 90 axis when the can is held thereby. This will result in an additional wobbling effect as in the case of apparatus 500 of FIG. 11.

Figure 13:
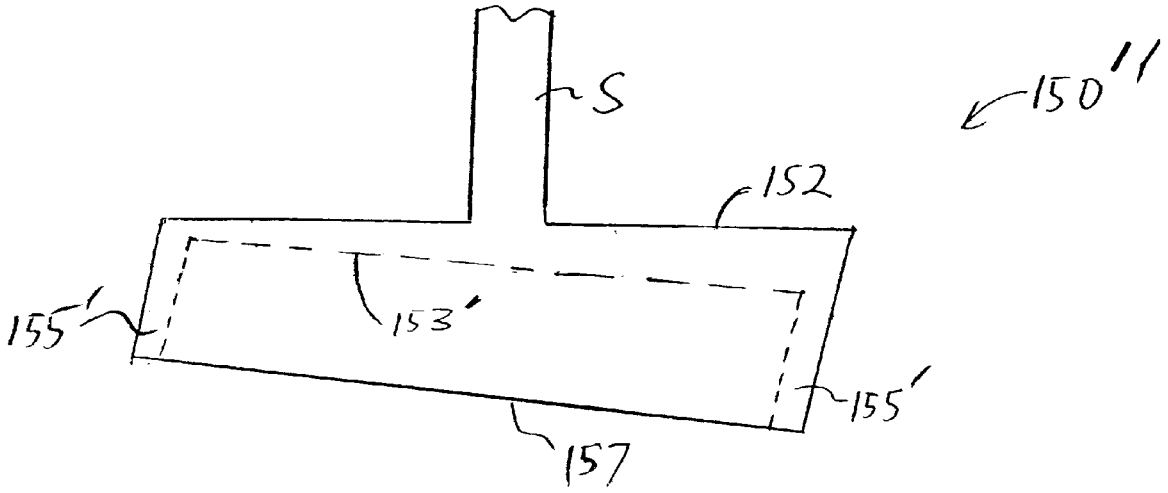
FIG. 13 is a side view of an exemplary can holding member used in the apparatus of FIG. 12.

FIG. 13 depicts a side view of an illustrative embodiment of holding member 150". Holding member 150" is a hollow sleeve-type holder similar to holding member 150 described in reference to FIGS. 5A–5C, except designed to retain a can or other container suspended in a slanted orientation relative to rotating shaft S. This is accomplished by means of cylindrical rim portion 155' being slanted with respect to shaft S so as to retain the can skewed via compressive force against the can surface. In addition, inner surface 153' is at a right angle with respect to rim portion 155' to enable the entire top surface of a can to rest against it when the can is fully inserted within holding member 150". Although not shown in FIG. 13, rim portion 155' is preferably composed of a hard plastic exterior and a rubber interior as was illustrated in FIG. 5B for holding member 150. Optionally, the bottom surface 157 of the circular rim 155' is also skewed relative to the perpendicular of shaft S.

In any event, it is understood that other holding member designs are also possible, such as a skewed suction cup design. In essence, the embodiment of FIG. 12 can be achieved with any holding member capable of maintaining the container to be chilled in a skewed orientation with respect to shaft S during the course of its rapid rotation.

From the foregoing, it will be appreciated that liquid chilling apparatuses in accordance with the invention exhibit a host of advantages as compared to devices of the prior art. For instance, in contrast to prior art designs mentioned earlier, there is no need for frictional contact of the can to be chilled with solid ice. Further, in contrast to the prior art wine chilling technique of rotating a housing surrounding a wine bottle to swirl coolant around the wine bottle, the present invention contemplates rotation of a can itself. By rotating the can, rather than keeping the can stationary and swirling coolant around the can, the heat transfer between the liquid within the can and the coolant is faster because the liquid to be cooled is in constant motion against the can wall. As a result, the canned liquid is cooled in a shorter time frame than it would otherwise be if the coolant swirling technique were used. Moreover, the "wobbling can" embodiments described in reference to FIGS. 11 and 12 achieve even faster chilling times.

While the present invention has been described above in reference to preferred embodiments thereof, it is understood that these embodiments are merely exemplary and that one skilled in the art can make many variations to the disclosed embodiments without departing from the spirit and scope of the invention as defined by the appended claims.

I claim:

1. A chilling apparatus for chilling a liquid in a container, comprising:

a compartment sized to accept and retain said container; and a coolant receptacle adjoining a part of a side portion of said compartment, for retaining a coolant, said side portion of said compartment having at least one aperture to enable said coolant to flow through to enter said compartment and surround said container therein;

wherein the liquid in said container is rapidly chilled by said coolant when the container is rotated within said compartment by a rotation means.

2. The chilling apparatus of claim 1 wherein said container is a cylindrical can.

3. The chilling apparatus of claim 1 wherein said coolant is an ice/water mixture and said aperture is smaller than a standard size ice cube to prevent ice cubes from entering said compartment.

4. The chilling apparatus of claim 1 wherein said at least one aperture is a plurality of circular apertures.

5. The chilling apparatus of claim 1 wherein said compartment is cylindrical and said coolant receptacle is formed with a base and four sides, with one of said four sides being defined by the side portion of said compartment.

6. The chilling, apparatus of claim 1, further comprising, in combination therewith, a holding member removably attachable to a top portion of said container, to hold said container and facilitate rotation thereof during chilling.

7. The chilling apparatus of claim 6, further comprising a hand crank attached to said holding member for facilitating manual rotation of said container.

8. The chilling apparatus of claim 7, further comprising a cover fitting over a perimeter of said apparatus, wherein a shaft of said hand crank passes through an aperture of said cover and connects to said holding member.

9. The chilling apparatus of claim 8, wherein said cover has an aperture overlaying said coolant receptacle to enable filling of said receptacle with coolant when said cover is already fitted atop said apparatus.

10. The chilling apparatus of claim 6 wherein said holding member is in the general shape of a lid having a rim portion, said rim portion having a plastic outer portion and having a rubber sleeve on an interior portion to hold said container during rotation thereof via a compressive force.

11. The chilling apparatus of claim 1, wherein said side portion of said compartment has a notch on a top part portion thereof, said notch facilitating removal of said container from said compartment.

12. The chilling apparatus of claim 1, further comprising an electric motor and a container holding member operatively coupled to said motor, for automatically rotating said container in said compartment.

13. The chilling apparatus of claim 1, further comprising a salt dispenser annexed to at least one of said compartment and said receptacle, for receiving and dispensing salt into said coolant within said compartment.

14. The chilling apparatus of claim 1, further comprising, in combination therewith, a holding member removably attachable to a top portion of said container, to hold said container and facilitate rotation thereof during chilling, wherein said holding member includes a rotating shaft that imparts wobbling rotation to said container when said shaft is rotated, said wobbling rotation serving to reduce chilling time of the liquid in said container.

15. The chilling apparatus of claim 14, wherein said wobbling rotation is implemented by means of said shaft being laterally offset with respect to the container axis when held by said holding member.

16. The chilling apparatus of claim 14, wherein said wobbling rotation is implemented by means of said holding member holding the container in a tilted orientation with respect to said shaft during rotation of said shaft.

17. A method of rapidly chilling a liquid in a container, comprising the steps of:

placing said container in a compartment of a chilling apparatus;

placing a coolant in a coolant receptacle of said chilling apparatus adjoining a part of a side portion of said compartment, said side portion of said compartment having at least one aperture such that said coolant passes through to said compartment and surrounds said container therein; and rotating said container within said compartment to thereby chill the liquid in said container.

18. The method of claim 17 wherein said container is a can.

19. The method of claim 17 wherein said step of placing a coolant in a coolant receptacle comprises placing ice cubes larger than said at least one aperture in said coolant receptacle and placing water in said coolant receptacle or compartment.

20. The method of claim 17 wherein said step of rotating said container is performed by a manual operation.

21. The method of claim 20 wherein said manual operation comprises attaching an L-shaped member to a top portion of said container and rotating said L-shaped member.

22. The method of claim 17 wherein said step of rotating is performed by means of an electric motor operatively coupled to a holding member holding said container immersed within said coolant.

23. The method of claim 17 wherein said step of rotating said container is performed in a manner such that said container is intentionally wobbled during its rotation.

24. A chilling apparatus for chilling a liquid in a container, comprising:

a compartment sized to accept and retain said container;

a coolant receptacle disposed adjacent to at least a portion of said compartment, for retaining a coolant, said at least a portion of said compartment having at least one aperture to enable said coolant to flow through to enter said compartment and surround said container therein; and means for imparting wobbling rotation of said container within said compartment to enable the liquid in said container to be rapidly chilled by said coolant during said wobbling rotation.

25. The chilling apparatus of claim 24 wherein said means for imparting wobbling rotation comprises a holding member attached to or including a shaft having a shaft axis, said shaft being laterally offset with respect to an axis of said container when said container is held by said holding member, wherein said container wobbles as said shaft rotates about the shaft axis.

26. The chilling apparatus of claim 24 wherein said means for imparting wobbling rotation comprises a holding member attached to or including a shaft having a shaft axis, said holding member retaining said container at a skewed orientation with respect to said shaft axis, wherein said container wobbles as said shaft rotates about the shaft axis.

27. A chilling apparatus for chilling a liquid in a container, comprising:

a compartment sized to accept and retain said container;

a coolant receptacle adjoining at least a side portion of said compartment, for retaining a coolant, said side portion of said compartment having at least one aperture to enable said coolant to flow through to enter said compartment and surround said container therein, wherein the liquid in said container is rapidly chilled by said coolant when the container is rotated within said compartment by a rotation means; and a salt dispenser annexed to at least one of said compartment and said receptacle, for receiving and dispensing salt into said coolant within said compartment.

28. A chilling apparatus for chilling a liquid in a container, comprising:

a compartment sized to accept and retain said container;

a coolant receptacle adjoining at least a side portion of said compartment, for retaining a coolant, said side portion of said compartment having at least one aperture to enable said coolant to flow through to enter said compartment and surround said container therein, wherein the liquid in said container is rapidly chilled by said coolant when the container is rotated within said compartment by a rotation means;

wherein said side portion of said compartment has a notch on a top part thereof, said notch facilitating removal of said container from said compartment.

29. A chilling apparatus for chilling a liquid in a container, comprising:

a compartment sized to accept and retain said container;

a coolant receptacle adjoining at least a side portion of said compartment, for retaining a coolant, said side portion of said compartment having at least one aperture to enable said coolant to flow through to enter said compartment and surround said container therein;

rotation means for rotating said container within said compartment to thereby rapidly chill the e liquid in said container;

a holding member removably attachable to a top portion of said container, to hold said container and facilitate rotation thereof during chilling, said rotation means being attached to said holding member; and a cover fitting over a perimeter of said apparatus, wherein a shaft of said rotation means passes through an aperture of said cover and connects to said holding member, and said cover having an aperture overlaying said coolant receptacle to enable filling of said receptacle with coolant when said cover is already fitted atop said apparatus.

30. A chilling apparatus for chilling a liquid in a container, comprising:

a compartment sized to accept and retain said container; and a coolant receptacle adjoining only a side portion of said compartment, for retaining a coolant, said side portion of said compartment having at least one aperture to enable said coolant to flow through to enter said compartment and surround said container therein;

wherein the liquid in said container is rapidly chilled by said coolant when the container is rotated within said compartment by a rotation means.

* * * * *